US007055354B2

(12) United States Patent
Tondo et al.

(10) Patent No.: US 7,055,354 B2
(45) Date of Patent: Jun. 6, 2006

(54) METHOD FOR ADJUSTING A FLATTENER UNDER TRACTION AND CORRESPONDING DEVICE

(75) Inventors: Fabrice Tondo, Vitry sur Orne (FR); Jacques Yves Bourgon, Metz (FR); Pierre Vienot, Metz (FR); Christian Aussourd, Indre (FR)

(73) Assignee: USINOR, Puteaux (FR)

( * ) Notice: Subject to any disclaimer, the term of this patent is extended or adjusted under 35 U.S.C. 154(b) by 118 days.

(21) Appl. No.: 10/416,791

(22) PCT Filed: Nov. 2, 2001

(86) PCT No.: PCT/FR01/03398

§ 371 (c)(1),
(2), (4) Date: Oct. 21, 2003

(87) PCT Pub. No.: WO02/40190

PCT Pub. Date: May 23, 2002

(65) Prior Publication Data

US 2004/0059458 A1 Mar. 25, 2004

(30) Foreign Application Priority Data

Nov. 15, 2000 (FR) ..... 00 14746

(51) Int. Cl.
*B21D 1/02* (2006.01)

(52) U.S. Cl. ..... 72/14.4; 72/164

(58) Field of Classification Search ..... 72/164, 72/165, 160, 10.1, 13.4, 14.4
See application file for complete search history.

(56) References Cited

U.S. PATENT DOCUMENTS

| | | | | |
|---|---|---|---|---|
| 3,701,274 | A | 10/1972 | Roesch | |
| 3,916,661 | A * | 11/1975 | Hargreaves | 72/10.1 |
| 4,316,376 | A * | 2/1982 | Masui et al. | 72/161 |
| 4,651,549 | A * | 3/1987 | Masui | 72/161 |
| 4,698,990 | A * | 10/1987 | Petri et al. | 72/14.1 |
| 4,805,432 | A | 2/1989 | Paulhac | |
| 5,392,627 | A | 2/1995 | Benz | |
| 5,680,785 | A | 10/1997 | Quehen et al. | |
| 6,266,989 | B1 * | 7/2001 | Pohl et al. | 72/245 |
| 2004/0089044 | A1 * | 5/2004 | Tondo et al. | 72/160 |

* cited by examiner

*Primary Examiner*—Daniel C. Crane
(74) *Attorney, Agent, or Firm*—Sughrue Mion, PLLC

(57) ABSTRACT

The invention concerns a method for adjusting a flattener under traction and a corresponding device, for providing a metal strip (5) in particular a cold-rolled steel plate, comprising a cage (1), cage posts (8), two stacked cassettes (2, 3) supporting each a plurality of rollers (4) between which the metal strip (5) is fed. The invention is characterized in that it consists in measuring a physical quantity representing the angular position of said cassettes (2, 3) relative to the feeding direction of the said trip (5).

7 Claims, 2 Drawing Sheets

METHOD FOR ADJUSTING A FLATTENER UNDER TRACTION AND CORRESPONDING DEVICE

This application is a 371 PCT/FR01/03398, Nov. 2, 2001.

The invention relates to a method and a device for adjusting a multi-roller flattener under traction, which flattener is to flatten a metal strip, in particular cold-rolled sheet steel.

Before it is shaped by drawing, the cold-rolled sheet metal used in the fields of packaging, motor vehicles and electrical household appliances undergoes a specific surface treatment (tinning, galvanisation or zinc electroplating) in order, on the one hand, to protect the steel against corrosion and, on the other hand, to give it particular mechanical characteristics. The invention relates also to cold-rolled sheet stainless steel or cold-rolled sheet iron-nickel alloy of the Invar type.

Cold-rolled sheet metal often has substantial flatness defects, such as undulations at the edges or the centre and curvature over the length or width of the strip. These defects make the sheet metal unsuitable for the remainder of the manufacturing cycle: one possibility for correcting all the flatness defects of the strip is to cause it to pass into a multi-roller flattener under traction.

The sheet metal under traction passes at rates of the order of from 100 m/min to 700 m/min between rollers supported by two cassettes mounted in a frame, one at the bottom and the other at the top. The rollers are held in place by roller bearings and lateral thrust bearings. In order to obtain excellent flatness of the sheet metal, it is necessary from the outset to ensure correct adjustment of the cassettes supporting the rollers, which rollers have to be absolutely perpendicular to the nominal direction of movement of the strip. The positioning of a cassette in the frame is effected by contact of the bearing surfaces of the cassette against the thrust bearings of the uprights of the frame. However, it sometimes happens that this positioning is not entirely satisfactory, and this gives rise to lateral forces which are applied to the rollers and to their thrust bearings.

If these lateral forces against the thrust bearings exceed the intensity that the thrust bearings can withstand, the result will be their fracture through fatigue and the partial or total destruction of the rollers. As soon as a roller breaks, often the roller of a given cassette that is the closest to the flattener inlet, the cassette is unusable and flattening is impossible. This event makes it necessary to stop the production line in order to change the cassette(s), at least one roller of which has just broken, and this leads to a loss in productivity and also substantial financial losses.

The cassettes of a flattener must have an average service life of the order of one month in the context of optimum use of the line, that is to say, if the cassettes are adjusted in such a manner that the rollers supported by the cassettes are absolutely perpendicular to the direction of movement of the strip.

However, an incorrect adjustment or a loss of adjustment of the cassettes may in some cases generate lateral forces such that the lateral thrust bearings and the rollers may be destroyed after a few hours of the sheet metal passing between the rollers.

The object of the invention is therefore to propose a method and a device for adjusting a multi-roller flattener under traction which ensures a service life of the cassettes compatible with production requirements.

The invention relates to a method for checking the adjustment of a flattener under traction which is to flatten a metal strip, in particular cold-rolled sheet steel, of the type comprising a frame, frame uprights and two stacked cassettes each supporting a plurality of rollers between which the metal strip passes, characterised in that a quantity representing the angular position of the cassettes relative to the direction of movement of the strip is measured and, if necessary, the angular position of the cassettes is corrected in order to cause it to comply with a predefined angular position.

According to other preferred features of the invention:

- the quantity representing the angular position of the cassettes relative to the direction of movement of the strip is constituted by the lateral forces, generated by the rotation of the rollers, on the cassettes;
- the angular position of the cassettes is corrected by inserting at least one means permitting modification of the angular position of at least one cassette relative to the frame between at least one upright of the frame and at least one cassette as a function of the results of the measurement representing the angular position.

The invention relates also to a device for adjusting a flattener of the type comprising a frame, frame uprights and two stacked cassettes each supporting a plurality of rollers between which a metal strip passes, each of the ends of the rollers provided with a lengthening piece being in contact with a thrust ball bearing connected to a preloading spring, which is itself connected to a bearing piece which slides longitudinally when the roller moves laterally, the device comprising two sensors connected to the bearing pieces, measuring quantities representing the angular position of the cassettes relative to the direction of movement of the strip, and at least one adjusting means permitting modification of the angular position of the cassettes relative to the frame as a function of the measurements provided by the sensors.

According to other features of the invention:

- the means for modifying the angular position of the cassettes relative to the frame is a shim;
- the adjusting means for modifying the angular position of the cassettes relative to the frame is constituted by an element of variable thickness;
- the device comprises automatic means for inserting the adjusting means permitting modification of the angular position of the cassettes relative to the frame as a function of the measurements provided by the sensors.

As will have been appreciated, the invention consists in measuring the lateral forces generated by the rollers on the thrust bearings. If an intensity is detected which reaches a threshold which is determined in advance as a function of the mechanical constraints of the installation and which cannot be exceeded without breaking the rollers, it is thus possible to stop the movement of the strip and to take rapid action to adjust the cassettes, in order to prevent the rollers from being destroyed.

The features and advantages of the invention will emerge on reading the following description which is given by way of example and with reference to the appended drawings in which.

Figure 1:
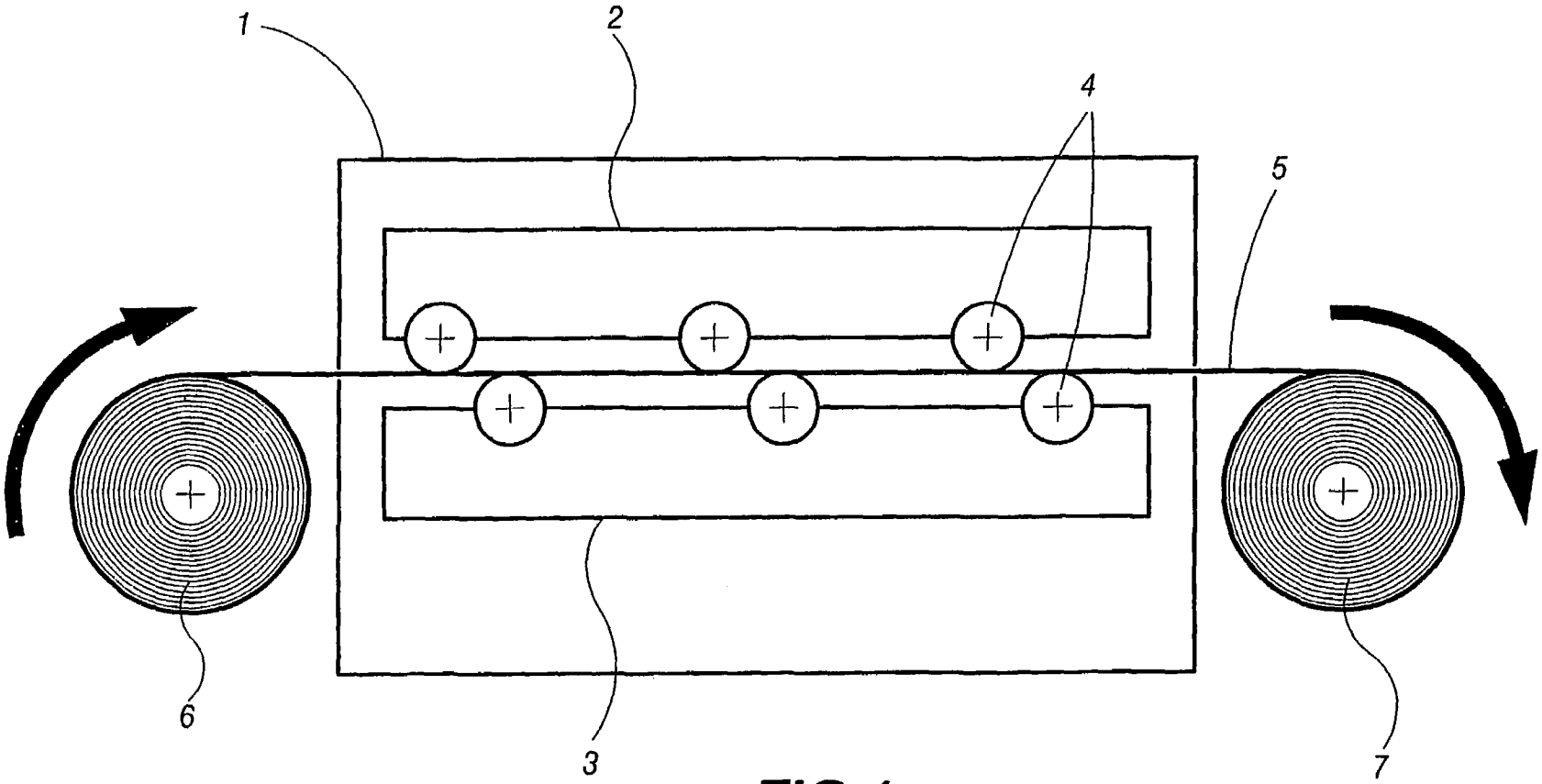
FIG. 1 is a diagrammatic view in cross-section of a multi-roller flattener under traction.

FIG. 1 shows diagrammatically a multi-roller flattener under traction, which flattener is constituted by a frame 1 and two stacked cassettes 2, 3 supporting rollers 4 which are positioned in an offset manner relative to one another and between which a cold-rolled metal strip 5 passes. The motorised units for placing the sheet metal under traction are shown at 6 and 7.

Figure 2:
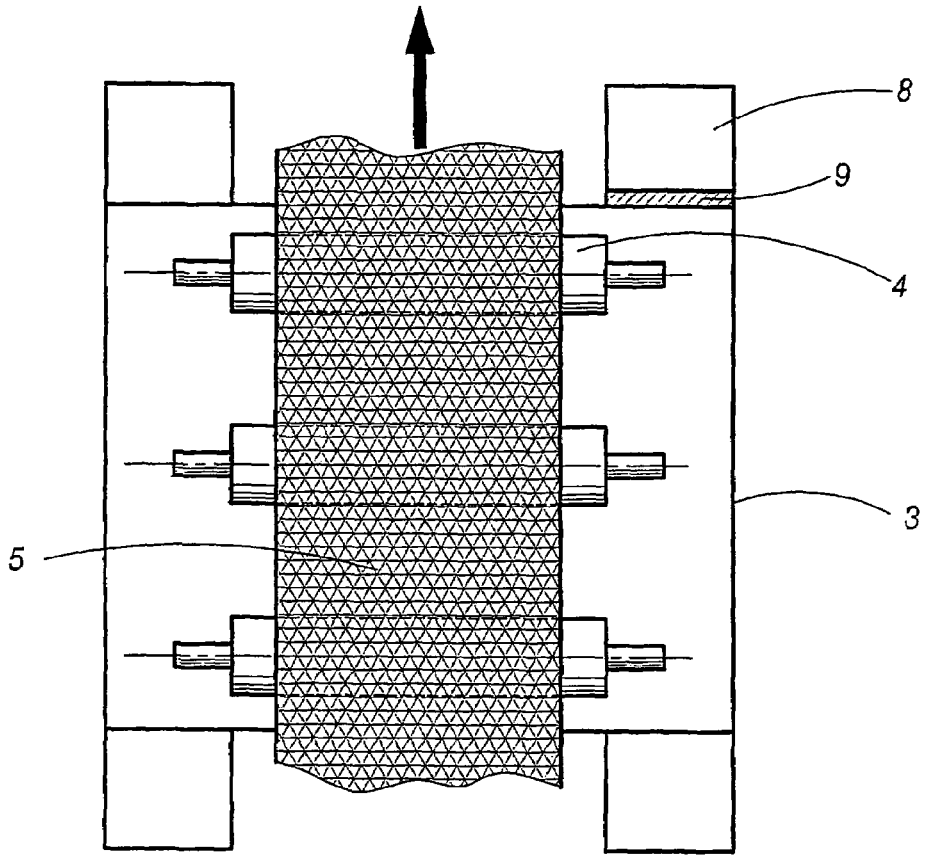
FIG. 2 is a top view of a cassette held in position by the uprights of the flattener frame.

FIG. 2 shows only the lower cassette 3 supporting the rollers 4 over which the cold-rolled strip 5 passes. The cassette 3 is held in place in the frame 1 by the uprights 8 of the frame 1, the orientation of the cassette 3 being, according to the invention, ensured by at least one means permitting modification of the angular position of the cassettes 2, 3 relative to the frame 1, so that the orientations of the rollers 4 of the cassette 3 and of the axis of the moving strip 5 are absolutely perpendicular. In the example shown, this means is constituted by a shim 9 inserted between one of the uprights 8 of the frame 1 and the cassette 3.

Figure 3:
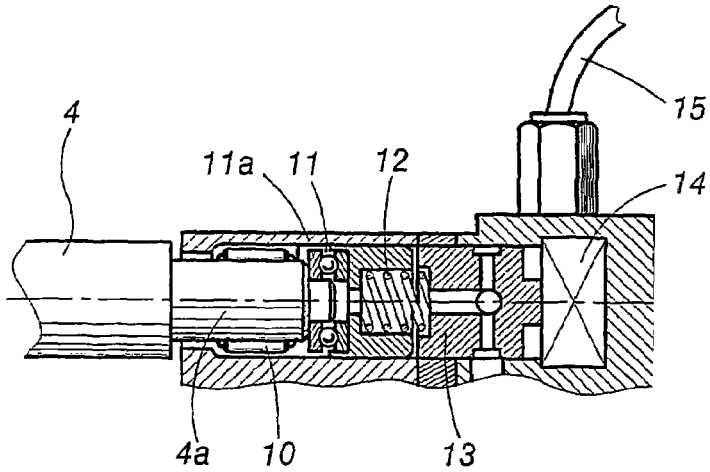
FIG. 3 is a cross-sectional view of a roller connected to a force sensor.

FIG. 3 shows a flattening roller 4 provided with a lengthening piece 4*a*, the rotation of which is ensured by a rolling element, such as a needle roller bearing 10. The end of the lengthening piece 4*a* of the roller 4 is in contact with a thrust ball bearing 11 in order to avoid friction of the roller 4 against the structure of the cassette 2, 3 of the flattener in the lateral direction.

The thrust ball bearing 11 is connected to a preloading spring 12 which enables the rolling elements to be kept in contact with the two collars 11*a* of the thrust ball bearing 11.

The preloading spring 12 is connected to a bearing piece 13 which slides longitudinally when the roller 4, during its rotation, moves laterally, in the case where the cassette 2, 3 carrying the rollers 4 is incorrectly adjusted or loses its adjustment.

A force sensor 14 in contact with the bearing piece 13 measures the intensity of the forces generated by any lateral displacement of the roller 4 and sends a measurement signal which, when it exceeds a critical threshold determined in advance as a function of the mechanical constraints of the installation, brings about an adjustment of the positioning of the cassette 2, 3. A connection 15 connected to the force sensor 14 returns this measurement signal to the means for transmitting data to the operator who is managing the adjustment.

The invention may be used as follows.

When the cassettes 2, 3 have just been changed, these cassettes 2, 3 are first of all adjusted. The metal strip 5 is caused to pass between the rollers 4 of the flattener and the force intensity measured by the force sensor(s) 14 is recorded. If necessary, the orientation of the cassettes 2, 3 is corrected by suitable adjustment of the shims 9 in such a manner that the orientations of the rollers 4, the cassette 2, 3 and the moving sheet metal 5 are absolutely perpendicular and that, simultaneously, the lateral forces are minimised.

As soon as these adjustments have been made, it is possible to flatten the strip 5 without risk of breaking the rollers 4, the thrust bearings 11 and the strip 5.

Each instrumented roller 4 of the lower cassette and the upper cassette is connected to two independent force sensors 14, one on each side of the roller. Measurements of the intensity of the lateral forces are thus taken, two at the lower cassette and two at the upper cassette.

According to a variant of the invention, the insertion of the shim 9 between the upright 8 of the frame 1 and the cassette 3 is effected automatically.

In that case, the measurement signal is returned to the means for transmitting data to an installation which manages the adjustment automatically.

It will be appreciated that the device permitting modification of the angular position of the cassettes 2, 3 relative to the frame 1 is not limited to shims. Other devices, such as an element of variable thickness comprising one or more hydraulic jacks, may be used.

The invention claimed is:

1. Method for checking the adjustment of a flattener under traction which is to flatten a metal strip, of the type comprising a frame (1), frame uprights (8) and two stacked cassettes (2, 3) each supporting a plurality of rollers (4) between which the metal strip (5) passes, characterised in that a quantity representing the angular position of the cassettes (2, 3) relative to the direction of movement of the strip (5) is measured and, when necessary, the angular position of the cassettes is corrected in order to cause it to comply with a predefined angular position, wherein said quantity representing the angular position of the cassettes (2, 3) relative to the direction of movement of the strip (5) is constituted by the lateral forces, generated by the rotation of the rollers (4), on the cassettes (2, 3).

2. Method for adjusting a flattener according to claim 1, characterised in that the angular position of the cassettes (2, 3) is corrected by inserting at least one means permitting modification of the angular position of the cassettes (2, 3) relative to the frame (1) between at least one upright (8) of the frame (1) and at least one cassette (2, 3) as a function of the results of the measurement representing the angular position.

3. Method for adjusting a flattener according to claim 1, characterised in that said metal strip is a cold-rolled steel sheet.

4. Device for adjusting a flattener of the type comprising a frame (1), frame uprights (8) and two stacked cassettes (2, 3) each supporting a plurality of rollers (4) between which a metal strip (5) passes, each of the ends of the rollers (4) provided with a lengthening piece (4*a*) being in contact with a thrust ball bearing (11) connected to a preloading spring (12), which is itself connected to a bearing piece (13) which slides longitudinally when the roller (4) moves laterally, characterised in that the device comprises two sensors (14), connected to the bearing pieces (13), measuring quantities representing the angular position of the cassettes (2, 3) relative to the direction of movement of the strip (5), and at least one adjusting means for modifying the angular position of the cassettes (2, 3) relative to the frame (1) as a function of the measurements provided by the sensors (14).

5. Device for adjusting a flattener according to claim 4, characterised in that the means for modifying the angular position of the cassettes (2, 3) relative to the frame (1) is a shim (9).

6. Device for adjusting a flattener according to claim 4, characterised in that the adjusting means for modifying the angular position of the cassettes (2, 3) relative to the frame (1) is constituted by an element of variable thickness.

7. Device for adjusting a flattener according to claim 4, characterised in that said device comprises automatic means for inserting the adjusting means permitting modification of the angular position of the cassettes (2, 3) relative to the frame (1) as a function of the measurements provided by the sensors (14).

* * * * *